United States Patent [19]

Rosenqvist

[11] 4,330,994

[45] May 25, 1982

[54] DOUBLE-ACTING HOT GAS ENGINE ASSEMBLAGE

[75] Inventor: Nils K. G. Rosenqvist, Malmö, Sweden

[73] Assignee: Kommanditbolaget United Stirling AB & Co., Malmö, Sweden

[21] Appl. No.: 91,038

[22] Filed: Nov. 5, 1979

[51] Int. Cl.[3] ..... F02G 1/04

[52] U.S. Cl. ..... 60/525; 123/52 A

[58] Field of Search ..... 60/525, 716; 123/52 A

[56] References Cited

U.S. PATENT DOCUMENTS 4,191,019 3/1980 Bratt et al. ..... 60/525

4,214,447 7/1980 Barton ..... 60/525

*Primary Examiner*—Allen M. Ostrager

*Attorney, Agent, or Firm*—Finnegan, Henderson, Farabow, Garrett & Dunner

[57] ABSTRACT

A number of hot gas engine units each having a plurality of pistons working upon two parallel crank shafts may form an assemblage of relative short axial length by axially connecting one crank shaft of each unit to a crank shaft of another unit and locating the other crank shaft of each unit at alternating sides of the axially connected crank shafts.

3 Claims, 3 Drawing Figures

DOUBLE-ACTING HOT GAS ENGINE ASSEMBLAGE

This invention relates to a double-acting hot gas engine assemblage comprising a plurality of engine units each of which having two parallel interconnected crank shafts being influenced by a plurality of pistons activated by pressure variations of hot gas charges.

An assemblage of this type has been described e.g. in the British Pat. No. 1,528,118.

It is sometimes desirable to arrange a multiple of engine units in a row in order to use a common crank shaft as an engine output shaft. The object of the present invention is to provide such assemblage in a compact manner i.e. to obtain a reduction of the total length of the assemblage.

According to the present invention this is obtained thereby that one crank shaft of each unit is coaxially connected to a crank shaft of another unit and that the other crank shafts of said units are mounted at alternating sides of the interconnected crank shafts.

Figure 1:
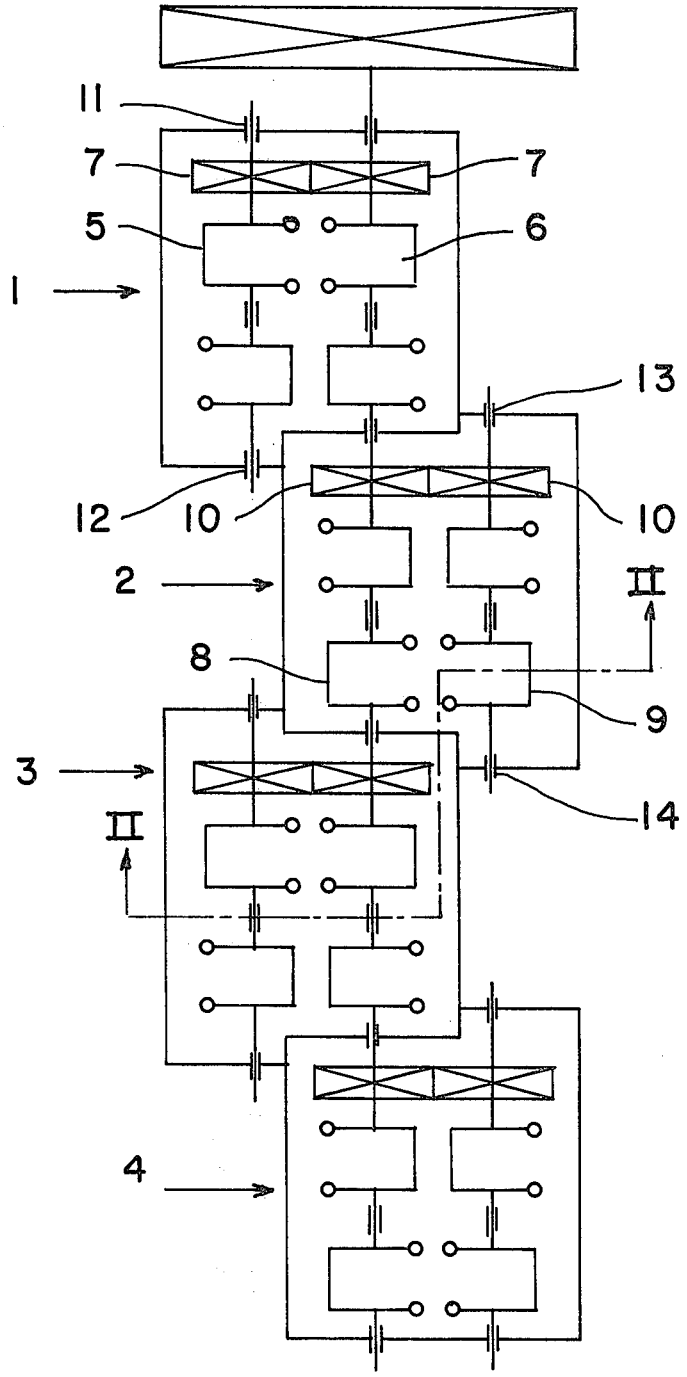
Figure 2:
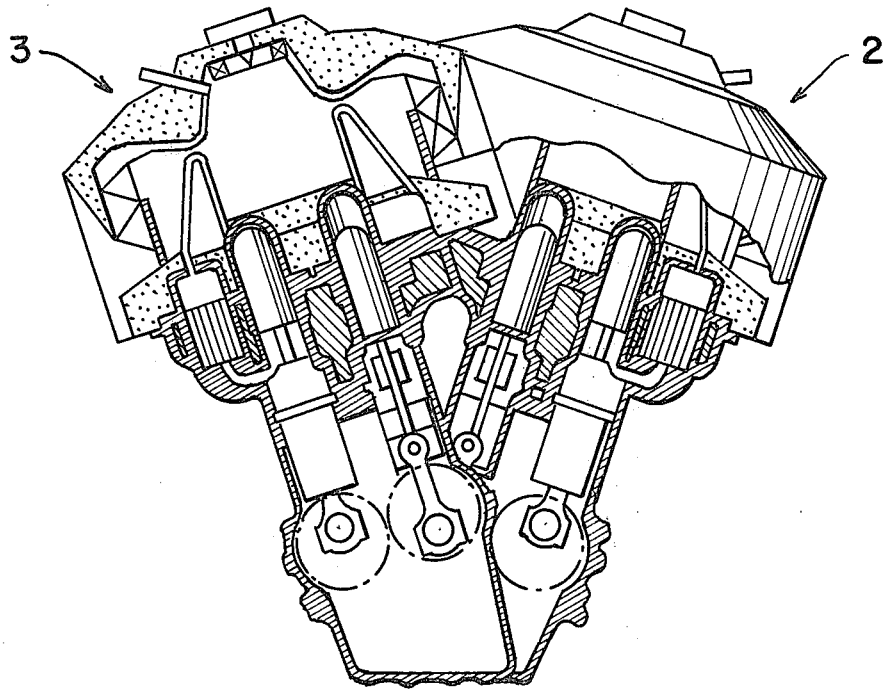
Figure 3:
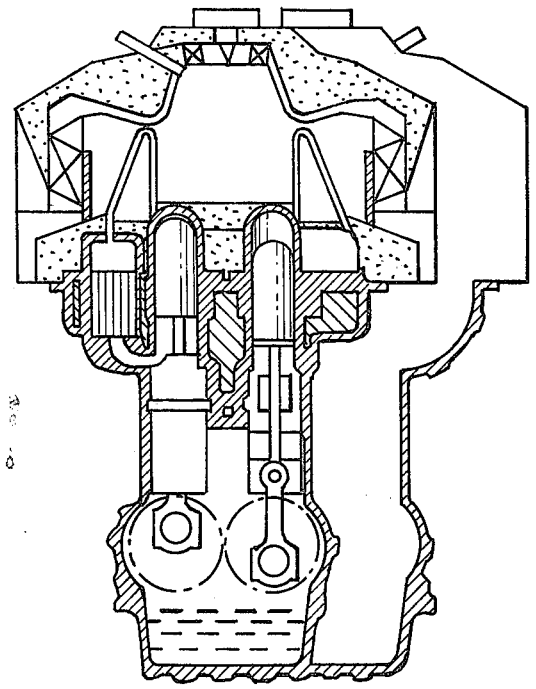

The invention will be described in more detail reference being made to the accompanying schematic drawings in which FIG. 1 is a diagrammatic view of a crank shaft arrangement of an assemblage according to the invention seen from above, FIG. 2 is a cross section along the line II—II of FIG. 1 of a specific embodiment of the invention and FIG. 3 is a cross section also along the line II—II of FIG. 1, but of another specific embodiment of the invention.

Referring first to FIG. 1. the reference numerals 1–4 designate four double-acting hot gas engine units of a type known e.g. from the British Patent Specification No. 1,521,444. Each unit has four pistons and four cylinders (not shown), the pistons acting upon two parallel crank shafts. The crank shafts of the unit 1 have been designated by the reference numerals 5 and 6. Each crank shaft is provided with two cranks.

The crank shafts 5 and 6 are interconnected for synchroneous rotation in opposite direction by two gear wheels 7.

The crank shafts of the unit 2 have been designated by 8 and 9. They are interconnected by gear wheels 10 in the same way as the crank shafts of the unit 1. The crank shaft 8 has been arranged as an axial extension of the crank shaft 6 in the unit 1. The crank shaft 9, however, has been mounted in a position opposite to the shaft 5 relative to common axis of the shafts 6 and 8. End bearings of the shaft 5 have been designated by the reference numerals 11 and 12 while end bearings of the shaft 9 have been designated 13 and 14.

It will be understood that the alternating sidewards position of the crank shafts 5 and 9 allows an axial overlapping of the bearings 12 and 13 and thus a shorter total axial dimension of the engine assemblage.

The piston-cylinder units (not shown in FIG. 1) working on the cranks of each unit are parallel to each other. However, as shown in FIG. 2, the directions of the cylinder axes of one unit may be angularly displaced relative the common axis of the crank shafts 6 and 8. Such arrangement will cause a more narrow bottom of the assemblage.

Of course, all cylinders of the units in the assemblage may be parallel as shown in FIG. 3.

I claim:

1. A double-acting hot gas engine assemblage comprising a plurality of engine units each of which having two parallel interconnected crank shafts being influenced by a plurality of pistons activated by pressure variations of hot gas charges characterised in that one crank shaft of each unit is coaxially connected to a crank shaft of another unit and that the other crank shafts of said units are mounted at alternating sides of the interconnected crank shafts.

2. An assemblage according to claim 1 characterised in that all cylinders are mounted in parallel directions.

3. An assemblage according to claim 1 characterised in that adjacent engine units are angularly displaced relative the axis of the interconnected crank shafts, said angular displacement being of equal magnitude and in alternating directions.

* * * * *